US009364047B2

(12) United States Patent
Fackler

(10) Patent No.: US 9,364,047 B2
(45) Date of Patent: Jun. 14, 2016

(54) ICE FLOP STOPPER

(71) Applicant: Frank L Fackler, Chicago, IL (US)

(72) Inventor: Frank L Fackler, Chicago, IL (US)

( * ) Notice: Subject to any disclaimer, the term of this patent is extended or adjusted under 35 U.S.C. 154(b) by 0 days.

(21) Appl. No.: 14/324,075

(22) Filed: Jul. 3, 2014

(65) Prior Publication Data

US 2016/0000186 A1 Jan. 7, 2016

(51) Int. Cl.
*A43C 15/06* (2006.01)
*A63C 13/00* (2006.01)
*A43C 15/00* (2006.01)

(52) U.S. Cl.
CPC ..... *A43C 15/061* (2013.01); *A43C 15/00* (2013.01); *A63C 13/003* (2013.01); *A63C 13/006* (2013.01)

(58) Field of Classification Search
CPC .... A43B 3/16; A43C 11/1406; A43C 15/061; A43C 15/06; A43C 15/09; A43C 15/006; A43C 15/003
USPC ..... 36/113, 114, 116, 117.2, 117.4, 117.5, 36/122, 123, 129, 7.7, 159, 160, 97, 1, 7.5, 36/7.6, 59 R, 62, 112, 115, 131, 132, 460, 36/305; 482/79
See application file for complete search history.

(56) References Cited

U.S. PATENT DOCUMENTS 800,734 A * 10/1905 Friedheim ..... 36/7.6
1,204,376 A * 11/1916 Newkirk ..... 2/305
1,207,005 A * 12/1916 Fache ..... 36/7.6
1,216,896 A * 2/1917 Webb ..... 36/7.6
1,458,497 A * 6/1923 Perkins ..... 36/7.6
1,539,762 A * 5/1925 Scipio ..... 36/97
1,562,128 A * 11/1925 Stanley ..... 450/29
1,749,522 A * 3/1930 Bertrand ..... 36/7.7
1,776,707 A * 9/1930 Schmeichel ..... 2/305
1,860,727 A * 5/1932 Ansley ..... 2/305
2,617,209 A * 11/1952 Jackson ..... 36/7.3
2,719,302 A * 10/1955 Cooperman ..... 2/73
3,019,533 A * 2/1962 Smith ..... 36/7.6
3,095,657 A * 7/1963 Fradette ..... 36/7.6
3,229,389 A * 1/1966 Adams ..... 36/7.6
3,609,888 A * 10/1971 Richman ..... 36/7.5
4,299,037 A * 11/1981 Carey ..... 36/7.6
4,353,172 A * 10/1982 Bryant ..... A43C 15/068 36/62
4,525,939 A * 7/1985 McNeil et al. ..... 36/7.6
5,125,479 A * 6/1992 Nemes ..... A63C 5/00 182/230

(Continued)

OTHER PUBLICATIONS

Http://link.springer.com/article/10.1007/s00421-011-1958-4/fulltext.html Changes in muscle contractile characteristics and jump height following 24 days of unilateral lower limb suspension, Apr. 20, 2011.*

(Continued)

*Primary Examiner* — Shaun R Hurley
*Assistant Examiner* — Bao-Thieu L Nguyen
(74) *Attorney, Agent, or Firm* — Fraline J. Allgaier

(57) ABSTRACT

A traction overshoe which enables a user to safely cover the footwear while sitting or standing. The traction overshoe has left side flaps, right side flaps and a tension cord system. The left side flaps and the right side flaps are contiguous with the front and back supports of the traction overshoe and a tension cord system is attached to the right side flaps and the left side flaps. In use, a user grips a bottom grip-bar and moves the left side flaps and the right side flaps into vertical positions. The user then slips the footwear into the device and moves the bottom grip-bar in an upward position to secure the left side flaps and the right side flaps against the footwear.

1 Claim, 4 Drawing Sheets

(56) References Cited

U.S. PATENT DOCUMENTS

| | | | | |
|---|---|---|---|---|
| 5,341,582 | A * | 8/1994 | Liautaud | 36/7.6 |
| 5,659,978 | A * | 8/1997 | Bell et al. | 36/7.6 |
| 5,689,901 | A * | 11/1997 | Bell et al. | 36/7.6 |
| 5,950,334 | A * | 9/1999 | Gerhardt | 36/59 R |
| 6,044,578 | A * | 4/2000 | Kelz | 36/7.5 |
| 6,154,982 | A * | 12/2000 | Bell et al. | 36/7.6 |
| 6,223,456 | B1 * | 5/2001 | Hawkins | 36/113 |
| 6,836,977 | B2 * | 1/2005 | Larson et al. | 36/59 R |
| 6,988,328 | B2 * | 1/2006 | Rosen et al. | 36/7.1 R |
| 7,716,855 | B2 * | 5/2010 | Gallay et al. | 36/122 |
| D664,331 | S * | 7/2012 | Weis | D2/906 |
| 8,827,873 | B2 * | 9/2014 | Arnstein | A61H 1/0266 482/79 |
| 2002/0095820 | A1 * | 7/2002 | Giovale | 36/7.6 |
| 2003/0154626 | A1 * | 8/2003 | Larson et al. | 36/7.6 |
| 2004/0016145 | A1 * | 1/2004 | Skrivan et al. | 36/7.6 |
| 2004/0045190 | A1 * | 3/2004 | Washburn et al. | 36/7.6 |
| 2004/0049943 | A1 * | 3/2004 | Glicksman | 36/7.1 R |
| 2004/0194346 | A1 * | 10/2004 | Petzl et al. | 36/59 R |
| 2005/0193588 | A1 * | 9/2005 | Dombowsky | 36/7.5 |
| 2007/0056187 | A1 * | 3/2007 | Burgess | 36/7.6 |
| 2009/0071034 | A1 * | 3/2009 | Lotterhos et al. | 36/7.3 |
| 2011/0047829 | A1 * | 3/2011 | Bell et al. | 36/134 |
| 2012/0266491 | A1 * | 10/2012 | May | 36/62 |
| 2013/0180130 | A1 * | 7/2013 | Giovale et al. | 36/62 |
| 2013/0312281 | A1 * | 11/2013 | Girard | 36/62 |
| 2013/0312282 | A1 * | 11/2013 | Girard | 36/62 |
| 2014/0215862 | A1 * | 8/2014 | Curl et al. | 36/59 R |

OTHER PUBLICATIONS

Http://blog.alpineinstitute.com/2011/03/rappelling-rope-climbing-trick.html Rappelling Rope Climbing Trick, Mar. 22, 2011.*

Http://www.rehab.research.va.gov/jour/04/41/5/Zancan.html A new hip-knee-ankle-foot sling: Kinematic comparison with a traditional ankle-foot orthosis, vol. 41 No. 5, Sep./Oct. 2004.*

Https://web.archive.org/web/20140315150206/http://www.itsalwaysautumn.com/wp-content/uploads/2014/01/fun-for-kids-rainy-day-crafts-activities-best-ideas-10.jpg Walking stilts for kids, Mar. 15, 2014.*

* cited by examiner

ICE FLOP STOPPER

CLAIM TO DOMESTIC PRIORITY

The present non-provisional application claims priority of U.S. Provisional Application Ser. No. 61/965,242 entitled "The Ice Flop Stopper", filed on Jan. 27, 2014, by Frank Lee Fackler, the entire contents of which is incorporated herein by reference thereto.

FIELD OF THE INVENTION

This application relates generally to footwear and more particularly to footwear covers which are adapted to provide traction and support for the bottom surfaces of various types of footwear.

BACKGROUND OF THE INVENTION

Injuries related to slips and falls are common during the winter months in many areas of the world. These injuries can occur while walking or performing common activities including walking to and from cars, buses or trains. These injuries can occur especially when walking on icy steps or icy sidewalks when entering or exiting vehicles. These types of activities would often require a person to pay special attention to avoid slipping and falling.

A variety of footwear has been developed to help individuals maneuver on icy surfaces. Many pedestrians have used boots with grooved bottoms, boots made of non-slip rubber or neoprene, anti-slip studs or ice grippers. However, many of these products still lack sufficient traction to grip the surface and might break during use. Products such as ice grippers can be difficult to stretch over the user's footwear. They can be especially difficult for those individuals who have arthritis or other hand related conditions that cause a limited range of motion, making it very difficult to stretch the grippers over their footwear.

Walking on ice requires footwear that will help prevent slips or falls that cause injuries. The device of the present invention offers superior winter walking assistance on ice or snow. It makes it easy for the user to put the device on from either a standing or sitting position. The device features front and back supports which allows it to stay in place while being worn. The plurality of ice cleats provides extra safety when walking on ice or packed snow. The tension cords are attached to the device and give the user a better sense of security and safety. This helps the user walk with a more natural stride.

The device can be manufactured in variable sizes and it can be worn by professionals, pedestrians, the elderly, and children. It will help to increase outdoor activity during winter months because of the ease of both putting on and removing the device.

SUMMARY OF THE INVENTION

In view of the problems associated with walking on ice or snow, it is an object of the present invention to provide a device that allows a person to safely walk on these surfaces.

Another objective of the present invention is to provide a device that affords security without slippage when walking or engaging in outdoor activities during winter months.

Another objective of the present invention is to provide a device that is secured directly to the footwear and the upper torso and allows the user to walk with additional security and confidence.

Still another objective of the present invention is to provide a device which is simple and economical in its construction and effective for its intended use.

In accordance with the present invention, a device that covers footwear and provides additional traction while walking on ice is provided. The device comprises a shoe base and cords. The shoe base can be constructed from a durable material that is resistant to oil, heat and weathering. The shoe base features a front support, a back support, cleats and side flaps.

The flaps are attached along the sides of the device. They are connected to a tension cord system that is adapted to fit across the top torso of a user's body. The flaps can retract into horizontal and upright positions to enable the user to slide his or her footwear onto the shoe base. Ice cleats are attached to the bottom of the shoe base. The cleats can be constructed from a durable material and are adapted to grip ice or hard snow. The cleats are adapted to hold its position in the ice when the shoe retainer is moved forward.

The device features cords that are adapted to fit across the top torso of a person's body. The cords are constructed of a durable elastic material and are adapted to be connected to the flaps. Additional advantages of the invention will become apparent from the following detailed description taken in conjunction with the accompanying drawings.

DETAILED DESCRIPTION OF THE INVENTION

This invention relates to a traction overshoe 10 that can be used by individuals requiring assistance putting on shoes or boots in icy or slick situations. Individuals with a physical handicap or upper body pain can put on the traction overshoe 10 while sitting or standing. The traction overshoe 10 can be made to accommodate various types of footwear 28 including tennis shoes, boots, sandals and dress shoes.

Figure 1:
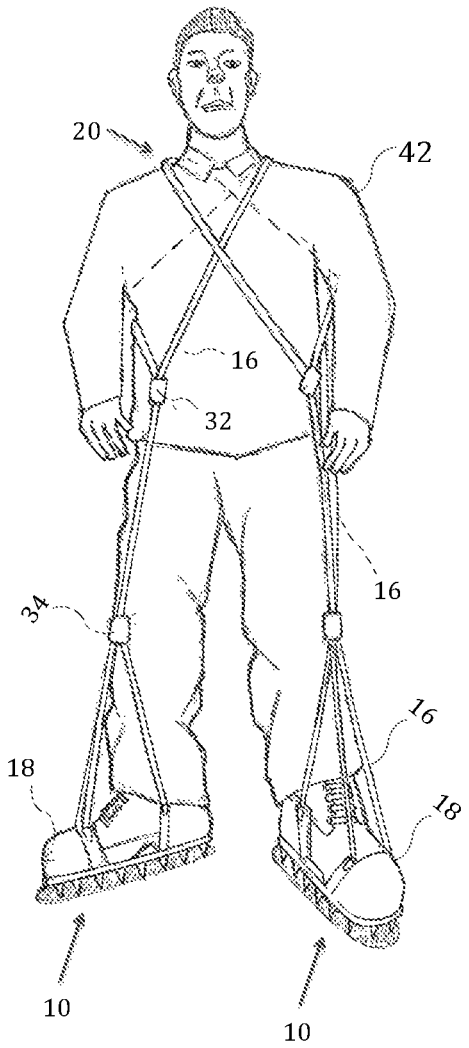
FIG. 1 illustrates a front view of a person using the traction overshoe and the left side flaps and the right side flaps being secured against the traction overshoe.
Figure 2:
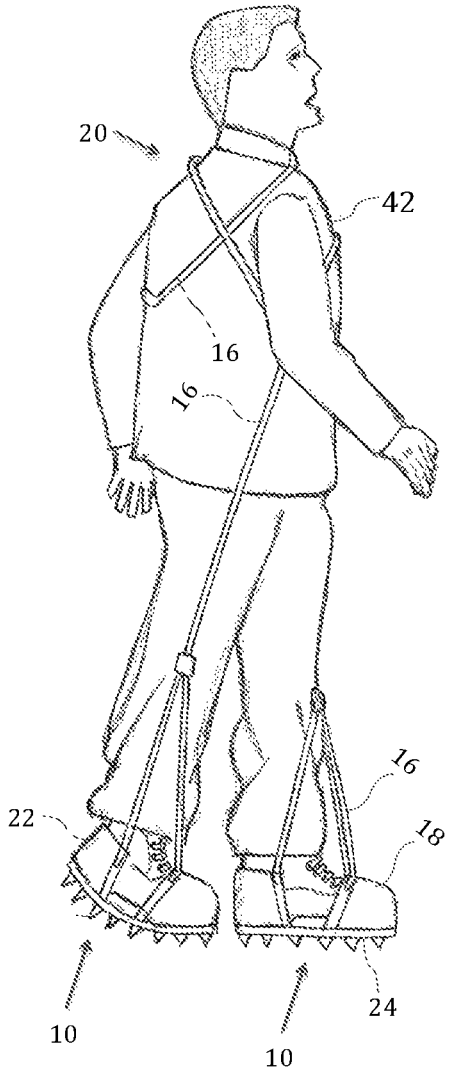
FIG. 2 illustrates a side view of a person using the traction overshoe and the left side flaps and the right side flaps being secured against the traction overshoe.
Figure 3:
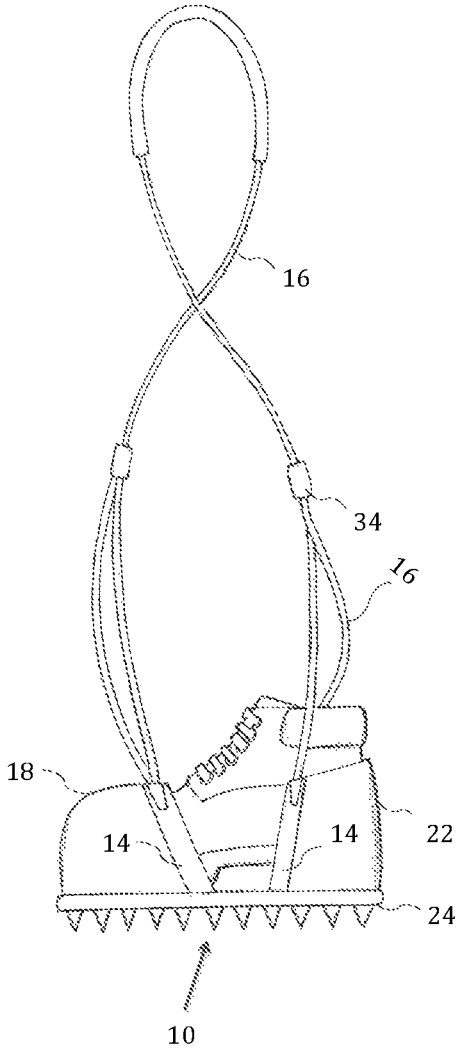
FIG. 3 illustrates a modified version of the traction overshoe attached to a smaller tension cord system having a plurality of bottom grip-bars.
Figure 4:
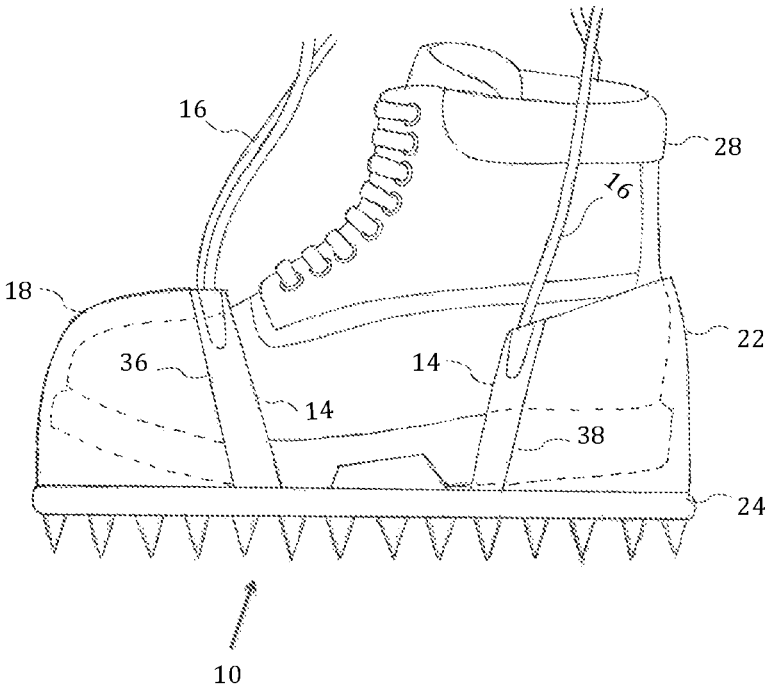
FIG. 4 is a perspective view of the traction overshoe.
Figure 5A:
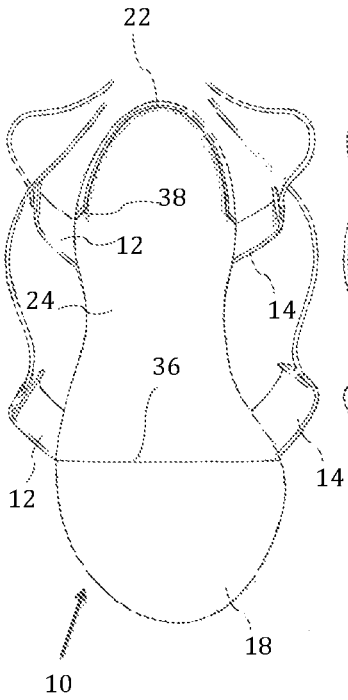
FIG. 5*a* is a top perspective view of a right traction overshoe being engaged to allow a user to insert his or her footwear.
Figure 5B:
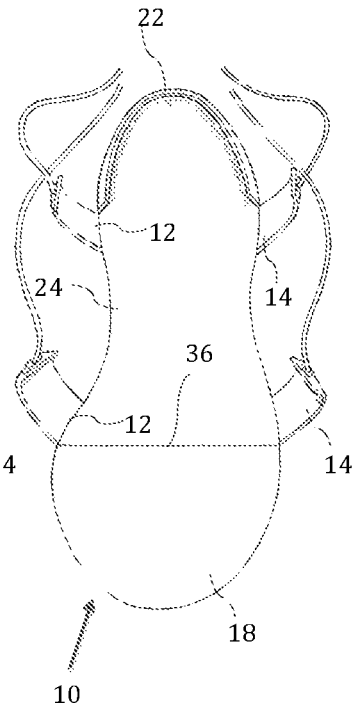
FIG. 5*b* is a top perspective view of a left traction overshoe being engaged to allow a user to insert his or her footwear.

Referring now to the drawings, FIG. 1 and FIG. 2 show the preferred embodiment of the improved traction overshoe 10. The traction overshoe 10 comprising right side flaps 12, left side flaps 14 and a tension cord system 16. The right side flaps 12 and the left side flaps 14 are located between the front portion 18 and the back portion 22 of the traction overshoe 10. The right side flaps 12 and the left side flaps 14 are sufficiently spaced to allow independent movement and are attached to the base 24 of the traction overshoe 10. The right side flaps 12 and the left side flaps 14 are adapted to move into horizontal and vertical positions to enable the user 20 to place his footwear 28 into the traction overshoe 10. The right side flaps 12 and the left side flaps 14 are attached to the tension cord system 16. The tension cord system 16 has a top grip-bar 32 and a bottom grip-bar 34.

With the traction overshoe 10 in a horizontal position, the user 20 grips the bottom grip-bar 34, relaxes the tension cord system 16, and allow the right side flaps 12 and the left side flaps 14 to move into horizontal positions. This allows the user 20 to slip the footwear 28 into the overshoe 10 and further adjust the right side flaps 12 and the left side flaps 14 against the side of the footwear 28 by pulling upwards on the bottom grip-bar 34. The top grip-bar 32 can be used to adjust the tension cord system 16 onto the torso 42. The tension cord system 16 can be draped over the head of the user 20 and slipped down to further engage with the torso 42.

The right side flaps 12 are contiguous with the adjacent edges of the front portion 36 and the adjacent edges of the back portion 38 of the traction overshoe 10 once the bottom grip-bar 34 is pulled upwards. The left side flaps 14 are contiguous with the adjacent edges of the front portion 36 and the contiguous edges of the back portion 38 once the bottom grip-bar 34 is pulled upwards. The right side flaps 12 and the left side flaps 14 are adapted to support the side of the footwear 28 while the traction overshoe 10 is being used.

The right side flaps 12 and the left side flaps 14 are constructed from a flexible material that enables the right side flaps 12 and the left side flaps 14 to move into horizontal and vertical positions when the tension cord system 16 is being used. Examples of flexible material that can be used are cloth, suede, leather, fabric and plastic.

The tension cord system 16 can have a nominal thickness of at least one inch and can have a variety of tension cord resistance force levels. The tension cord system 16 can be constructed from a durable elastic material and can have various heights to facilitate an easier mounting process.

What is claimed is:

1. An improved traction overshoe comprising: right side flaps, left side flaps and a tension cord system; said right side flaps and said left side flaps being located between the front portion and back portion of said traction overshoe; said right side flaps and said left side flaps being sufficiently spaced to allow independent movement of said right side flaps and said left side flaps; said right side flaps and said left side flaps being attached to said traction overshoe base; said right side flaps and said left side flaps being adapted to move into horizontal and vertical positions to enable the user to place his footwear into said traction overshoe; said right side flaps and said left side flaps being attached to said tension cord system; said tension cord system having a top grip-bar and a bottom grip-bar; said user gripping said bottom grip-bar and moving said right side flaps and said left side flaps into a horizontal position and allowing said user to insert said footwear into said traction overshoe; said bottom grip-bar being pulled up to move said right side flaps and said left side flaps into a vertical position on said traction overshoe; said right side flaps being contiguous with the adjacent edges of said front portion and said back portion of said traction overshoe once said bottom grip-bar is pulled upwards; said left side flaps being contiguous with the adjacent edges of said front portion and said back portion of said traction overshoe once said bottom grip-bar is pulled upwards; said top grip-bar being used to adjust said tension cord system onto said user's torso; said right side flaps and said left side flaps being adapted to support the side of said user's footwear while said traction overshoe is being used; said right side flaps and said left side flaps being constructed from a flexible material that enables said right side flaps and said left side flaps to move into horizontal and vertical positions when said tension cord system is being used.

* * * * *